US010322867B2

(12) United States Patent
Furneaux et al.

(10) Patent No.: US 10,322,867 B2
(45) Date of Patent: Jun. 18, 2019

(54) TRANSPORTABLE TRANSPARENT CORK-INSULATED COOLER

(71) Applicant: Sovaro Coolers, LLC, Rosewell, GA (US)

(72) Inventors: Todd McLean Furneaux, Roswell, GA (US); Gary M. Fischer, Jr., Poplar Grove, IL (US); Michael Thuma, La Grange, IL (US); William J. Phillips, Batavia, IL (US); Michael R. Vogler, Oswego, IL (US)

(73) Assignee: Sovaro Coolers, LLC, Roswell, GA (US)

( * ) Notice: Subject to any disclaimer, the term of this patent is extended or adjusted under 35 U.S.C. 154(b) by 461 days.

(21) Appl. No.: 15/166,649

(22) Filed: May 27, 2016

(65) Prior Publication Data

US 2016/0272405 A1 Sep. 22, 2016

Related U.S. Application Data

(63) Continuation-in-part of application No. 14/788,030, filed on Jun. 30, 2015, now Pat. No. 9,527,652.
(Continued)

(51) Int. Cl.

| | |
|---|---|
| ***B65D 81/38*** | (2006.01) |
| ***B65D 25/28*** | (2006.01) |
| ***B65D 43/16*** | (2006.01) |
| ***B65D 25/38*** | (2006.01) |
| ***B65D 19/00*** | (2006.01) |
| ***B65D 25/20*** | (2006.01) |
| ***F25D 3/06*** | (2006.01) |

(Continued)

(52) U.S. Cl.
CPC ..... *B65D 81/3823* (2013.01); *B65D 19/0002* (2013.01); *B65D 25/20* (2013.01); *B65D 25/2805* (2013.01); *B65D 25/38* (2013.01); *B65D 43/16* (2013.01); *B65D 43/167* (2013.01); *E05D 5/127* (2013.01); *E05D 11/082* (2013.01); *F25D 3/06* (2013.01); *F25D 23/028* (2013.01); *B65D 2525/286* (2013.01); *E05D 2003/025* (2013.01); *E05D 2005/102* (2013.01); *E05Y 2600/12* (2013.01); *E05Y 2600/504* (2013.01); *E05Y 2900/602* (2013.01); *F25D 2323/024* (2013.01)

(58) Field of Classification Search
CPC .. E05D 2011/085; E05D 11/08; E05D 11/084
USPC ..... 220/592.11, 592.09, 592.1, 592.23; 16/337
See application file for complete search history.

(56) References Cited

U.S. PATENT DOCUMENTS 1,812,777 A 6/1931 Frechou
1,854,853 A 4/1932 Merrylees
(Continued)

*Primary Examiner* — King M Chu
(74) *Attorney, Agent, or Firm* — McHale & Slavin, P.A.

(57) ABSTRACT

A cork-insulated cooler having a constant friction hinge assembly is described. The cooler is comprised of an outer basin having an open top, a plurality of cork panels lining the outer basin, a transparent inner basin having an open top which is constructed and arranged to hold and maintain the plurality of cork panels against the outer basin, a lid hingedly connected to the inner and outer basin, such that the lid can be positioned anywhere between a completely closed position to a completely open position and anywhere in between with the lid supporting itself in the chosen position.

11 Claims, 11 Drawing Sheets

Related U.S. Application Data

(60) Provisional application No. 62/029,805, filed on Jul. 28, 2014.

(51) Int. Cl.

| | |
|---|---|
| ***F25D 23/02*** | (2006.01) |
| ***E05D 5/12*** | (2006.01) |
| ***E05D 11/08*** | (2006.01) |
| *E05D 3/02* | (2006.01) |
| *E05D 5/10* | (2006.01) |

(56) References Cited

U.S. PATENT DOCUMENTS

| | | | | |
|---|---|---|---|---|
| 2,339,458 | A | 1/1944 | Champney | |
| 2,485,646 | A | 10/1949 | Norquist | |
| 2,652,698 | A | 9/1953 | Schlumbohm | |
| 3,161,031 | A | 12/1964 | Flannery | |
| 3,406,532 | A | 10/1968 | Rownd et al. | |
| 4,047,633 | A * | 9/1977 | Trombly | A47J 41/0072 220/23.87 |
| 4,927,041 | A | 5/1990 | Hepburn | |
| 4,947,991 | A | 8/1990 | Snell | |
| 5,231,734 | A * | 8/1993 | Rude | E05D 11/084 16/322 |
| 5,259,215 | A | 11/1993 | Rocca | |
| 6,244,066 | B1 | 6/2001 | LaRose | |
| 6,244,458 | B1 | 6/2001 | Frysinger et al. | |
| 7,066,347 | B2 | 6/2006 | Slovak et al. | |
| 7,147,125 | B1 | 12/2006 | Slovak et al. | |
| 7,677,406 | B2 | 3/2010 | Maxson | |
| 8,567,211 | B2 | 10/2013 | Al-Rasheed | |
| 2005/0279123 | A1 | 12/2005 | Maldonado et al. | |
| 2008/0178629 | A1 | 7/2008 | Meether | |

* cited by examiner

TRANSPORTABLE TRANSPARENT CORK-INSULATED COOLER

PRIORITY CLAIM

In accordance with 37 C.F.R. 1.76, a claim of priority is included in an Application Data Sheet filed concurrently herewith. Accordingly, the present invention claims priority as a continuation-in-part of U.S. patent application Ser. No. 14/788,030, filed Jun. 30, 2015, entitled "Transportable Transparent Cork-Insulated Cooler", which claims priority to U.S. Provisional Patent Application No. 62/029,805, filed Jul. 28, 2014, entitled "Cork Insulated Container". The contents of the above referenced applications are incorporated herein by reference in its entirety.

FIELD OF THE INVENTION

The present invention relates generally to containers for holding materials for storage, and more particularly to a cork-insulated cooler used for holding perishable food products having a transparent interior shell and reversible skid plates to assist with transportation thereof.

BACKGROUND OF THE INVENTION

A cooler, portable ice chest, ice box, or cool box is most commonly an insulated box used to keep food or drink cool. Ice cubes are most commonly placed in it to help maintain a cool temperature within the cooler. As an alternative, ice packs with gel contained therein are sometimes used because the gel absorbs heat as it changes phase, causing the ice packs to stay colder longer than just plain ice. Coolers are frequently taken on picnics, vacations, and holiday trips. When summer temperatures rise, coolers may also be used for maintaining cooler temperatures while transporting cold groceries home from the store; for example, keeping ice cream from melting in a hot automobile. Even without adding ice, the transportable transparent cork-insulated cooler of the present invention can be used just to maintain the cooler temperature of food products or beverages purchased at the supermarket.

Moreover, coolers are used in various settings where they either need to be transported from one area to another or they need to remain in place. Thus, versatility in allowing one to easily transport a cooler from one place to another while still being able to keep the cooler in place on a boat deck, truck bed, or in a vehicle trunk is of utmost importance to many cooler owners.

Coolers for holding beverages and storing ice are well known in the art. Typically, coolers are fabricated from four opaque plastic walls, an opaque bottom wall, and an opaque hinged lid. Collectively, the walls and lid define the storage chamber for storing ice, beverages, food, etc. Coolers are usually made with interior and exterior shells of opaque plastic with a hard foam liner in between. They come in sizes from small, personal ones to large, family ones that have wheels for ease of transportation. Most reusable coolers have molded-in-place handles; although a few have shoulder straps, and most also include wheels for easier transportation thereof Unfortunately, over time the hard foam located between the interior and exterior shells either deteriorates or develops mold because of a leak in the exterior or interior shell. The foam is porous, and thus allows water from melted ice in the cooler to flow through the insulation and back into the cooler where it mixes with the ice stored in the cooler. People then use the ice out of the cooler for cooling drinks and the like. The opaque plastic construction makes it impossible for the user to determine if the insulation is contaminating the products or ice contained within the cooler. Thus, food poisoning is a definite risk with the current cooler construction.

Thus, what is lacking in the art is a transparent inner shell and a naturally nonabsorbent insulation that allows a cooler owner to spot and inspect a leak between the shells before deterioration or contamination takes place. The transparent inner shell should allow a cooler owner to inspect for leaks frequently as a maintenance and preventative measure, while the natural insulation should prevent contamination from water flowing through the insulation, and should reduce the possibility of mold growth and contamination therefrom. When wheels are provided on the underside of the bottom wall of the proposed cooler, they should prevent the cooler sliding, shifting, tilting, or rolling when it is not intended to do so.

SUMMARY OF THE INVENTION

The present invention provides a cork-insulated cooler having reversible skid plates and a transparent inner liner. The cooler is comprised of an outer basin having an open top, a plurality of cork panels lining the inner surface of the outer basin, a transparent inner basin having an open top constructed and arranged to hold and maintain the plurality of cork panels against the outer basin, a lid assembly hingedly connected to the inner and outer basin such that the inner basin and lid cooperate to define a compartment, and at least one pair of reversible skid plates removably fastened to the bottom surface of the outer basin; the reversible skid plates including a skid side for easy sliding of the cooler and a non-skid side to keep the cooler in place.

Accordingly, it is an objective of the present invention to provide an insulated cooler having a transparent inner basin and reversible skid plates.

It is another objective of the present invention to provide a cooler having a natural cork insulation in place of foam.

It is a further objective of the present invention to provide a cooler having a transparent inner basin to allow for inspection and leak detection.

Yet a further objective of the present invention is to provide a cooler having a compartmentalized insulation area between the outer and inner basins.

An even further objective of the present invention is to provide a cooler wherein the compartmentalized insulation area prevents contamination from moving between the compartment areas.

Still yet a further objective of the present invention is to provide a cooler having a compartmentalized insulation area that prevents crushing of the insulation when subjected to heavy loads.

It is yet another objective of the instant invention to provide a cooler including reversible skid plates removably fastened to the bottom surface of the outer basin whereby the skid plates may be securely maintained beneath the bottom surface of the cooler.

It is still yet another objective of the instant invention to provide a cooler that is sturdy and lasting in construction, economical to assemble, i.e. cost effective to manufacture, and efficient in operation and use while possessing improved insulating characteristics.

Still yet a further objective of the instant invention is to provide a cooler including reversible skid plates having one side that facilitates the sliding of the cooler over a wide variety of supporting surfaces and an opposite non-skid side that prevents sliding and movement when the cooler owner desires non-movement and stability.

It is yet a further objective of the instant invention is to provide a cooler having a lid assembly hingedly connected to the basin top using constant torque friction hinges. The constant torque friction hinge provides continuous resistance against motion through the entire range of motion of the lid assembly (closed position to open position), thereby holding the position of the lid assembly anywhere along the range of motion thereof.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
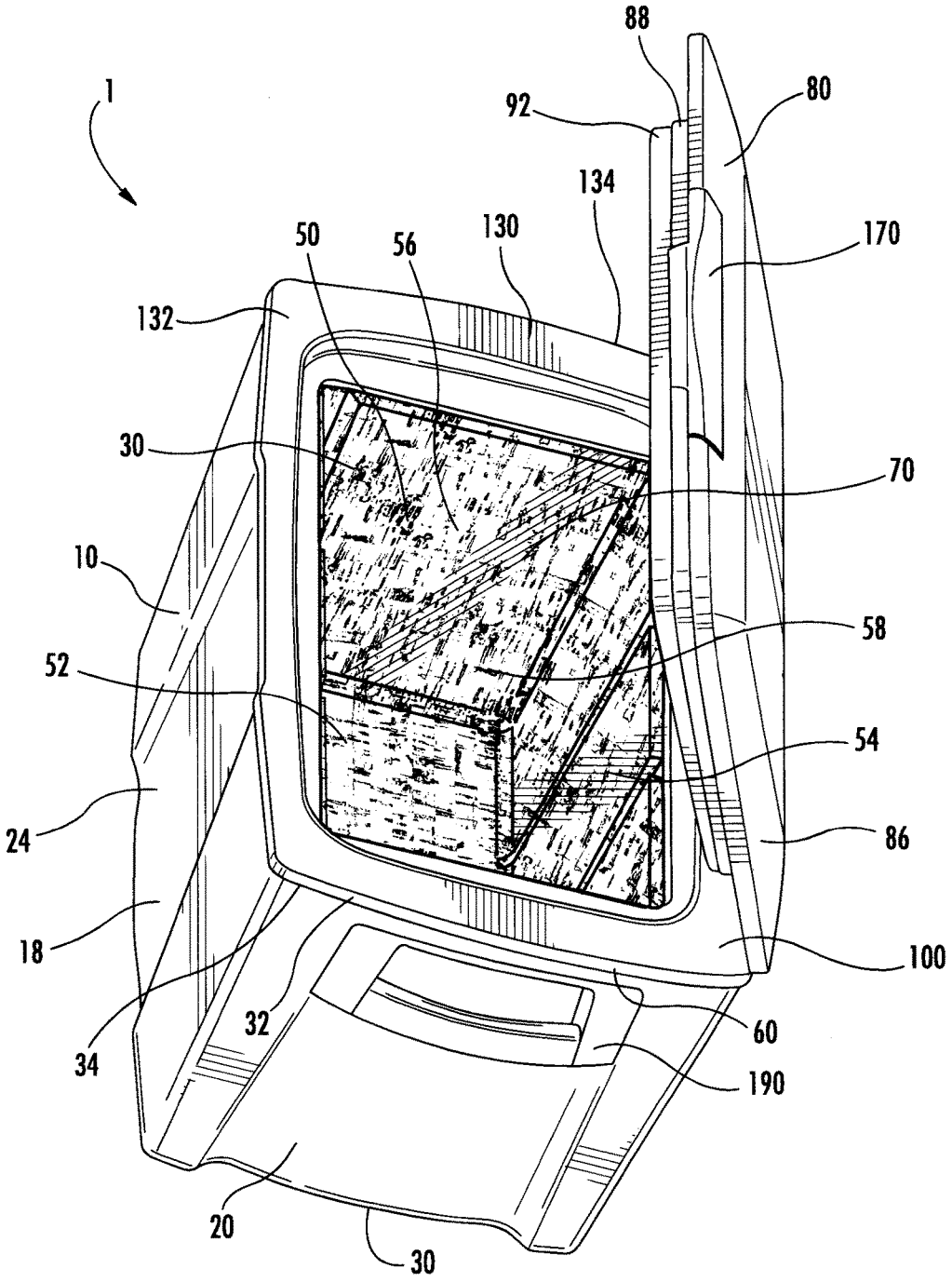
FIG. 1 is a perspective view of the preferred embodiment of the present invention.

While the present invention is susceptible of embodiment in various forms, there is shown in the drawings and will hereinafter be described a presently preferred, albeit not limiting, embodiment with the un derstanding that the present disclosure is to be considered an exemplification of the present invention and is not intended to limit the invention to the specific embodiments illustrated.

Referring generally to FIGS. 1-14, in which similar reference characters denote similar elements throughout several views, a cork-insulated cooler 1 having reversible skid plates 110 and a transparent inner basin 50 of the present invention is illustrated. Referring to FIG. 1, the preferred embodiment of the present invention is a cooler 1 comprised of an outer basin 10 having an open top 30, a plurality of cork panels 40 (FIGS. 4 and 5) lining the inside of the outer basin 10, a transparent inner basin 50 having an open top 58 which is constructed and arranged to hold and maintain the plurality of cork panels 40 between the outer surface of the inner basin and the inner surface of the outer basin 10, a lid assembly 80 hingedly connected to the outer and/or inner basin, 10 and 50, such that the transparent inner basin 50 and lid assembly 80 cooperate to define a compartment 70, and at least one pair of reversible skid plates 110 (FIG. 3, 4, 6A and 6B) removably fastened to a bottom surface 16 on the bottom panel 12 of the outer basin 10. The inner basin 50 is slightly smaller than the outer basin 10 in order to be positioned within the outer basin 10 and abut the plurality of cork panels 40. The outer basin 10 is comprised of a bottom wall 12, open top 30, and four sidewalls, 18 and 20, whereby one pair of sidewalls 18 are of a substantially longer length than the other pair of sidewalls 20 to form a rectangular compartment. The bottom panel 12 includes a top surface 14 (FIG. 5) and bottom surface 16. The bottom surface 16 includes apertures 28 (not shown) for receiving fasteners 120 (FIG. 4) for attaching the reversible skid plates 110 thereon. In the preferred embodiment, the apertures 28 are positioned along the corners of the bottom surface 16. The reversible skid plates 110 include a skid side 122 constructed from a low friction polymeric plastic material for easy sliding of the cooler and a non-skid side 124 constructed from a rubber type material to keep the cooler 1 in place, more aptly shown in FIGS. 6A and 6B. Each skid plate 110 is comprised of two intersecting legs, 112 and 114, that form an L-shape 116 with approximately a 90 degree angle between the legs, 112 and 114. Each leg, 112 and 114, also includes apertures 118 thereon that correspond to apertures 28 on the bottom surface 16 of the bottom wall 12 on the outer basin 10.

Figure 5:
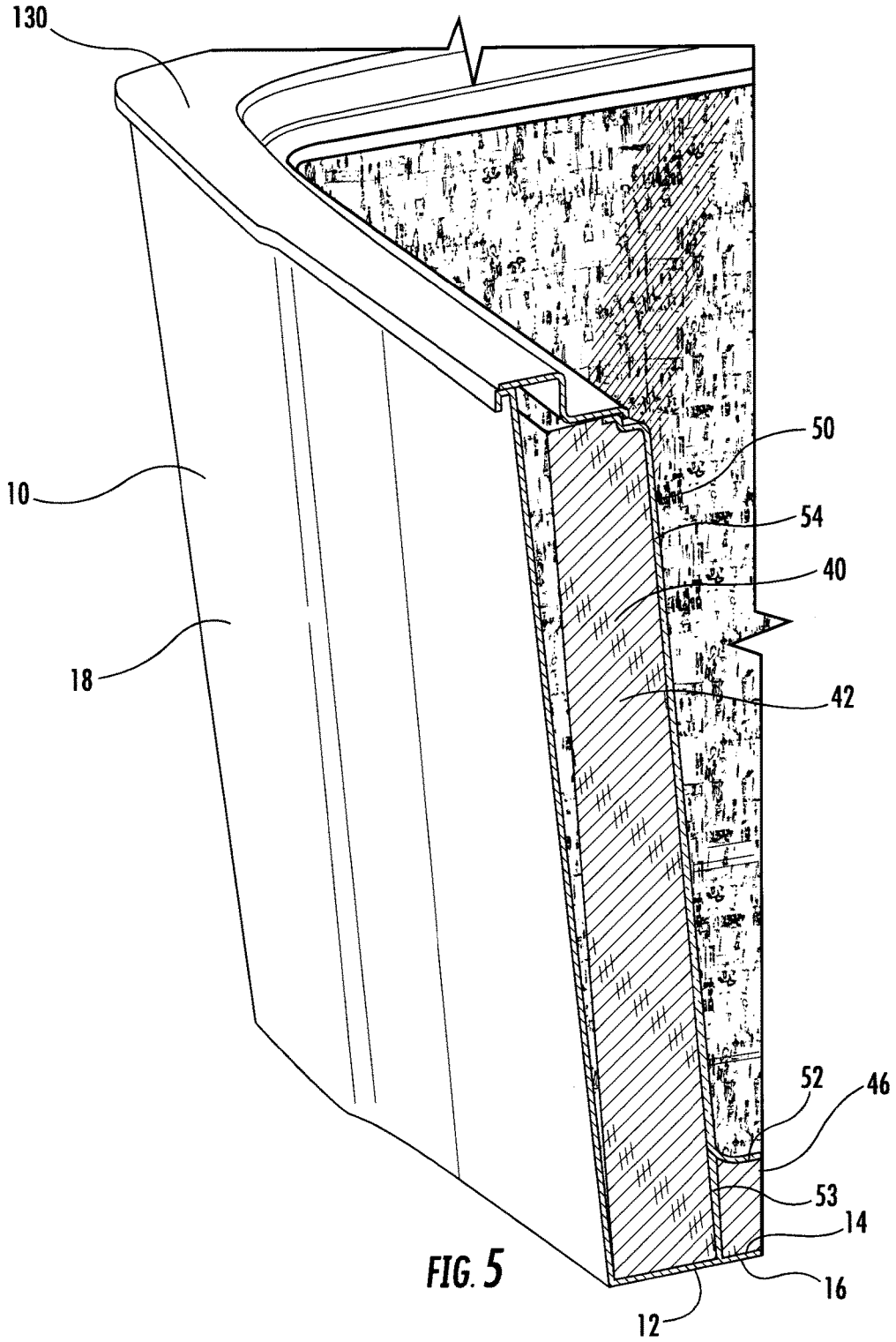
FIG. 5 is a cross-sectional view of the sidewall of the present invention.
Figure 6A:
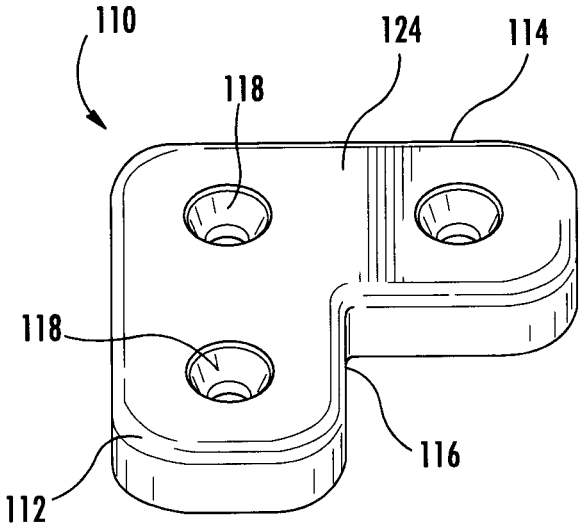
FIG. 6A is a top view of the skid plate of the present invention.
Figure 6B:
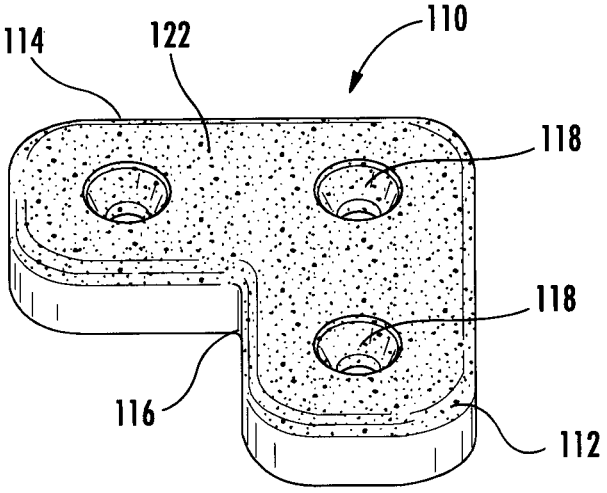
FIG. 6B is a bottom view of the skid plate of the present invention.
Figure 7:
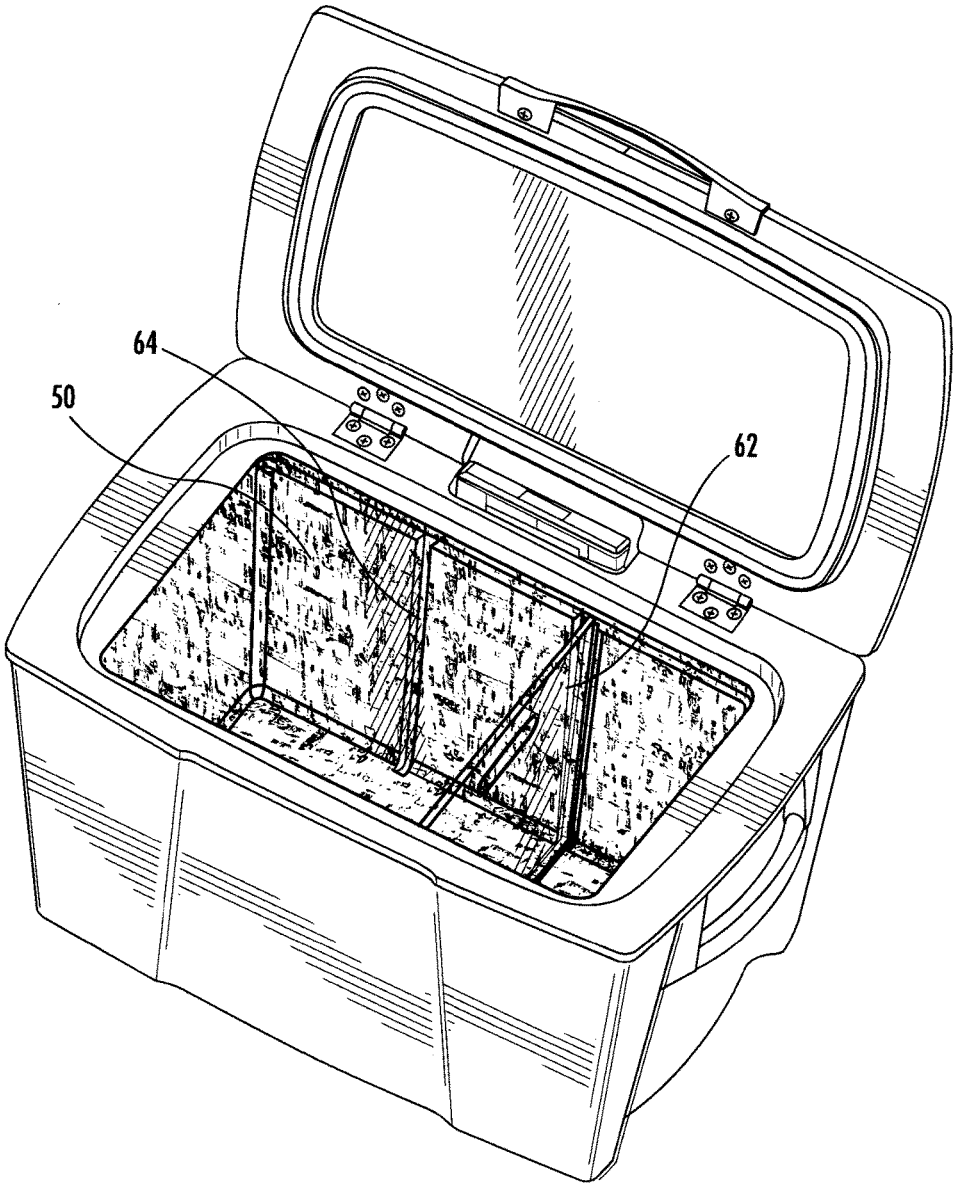
FIG. 7 is a perspective view of an alternative embodiment of the present invention.

As shown in FIG. 1, the transparent inner basin 50 is similarly comprised of a bottom wall 52 and four sidewalls, 54 and 56, whereby one pair of sidewalls 54 are of a substantially longer length than the other pair of sidewalls 56 to form a rectangular compartment when assembled; however, as discussed above, the transparent inner basin 50 rectangular construction is slightly smaller than the outer basin 10 rectangular construction. The inner basin includes an offset collar 53 that extends around the perimeter of the bottom wall for separating the cork panels from one another. This construction prevents contamination from cooler water from being transferred between the cork insulation panels. In its preferred embodiment, the offset collar 53 is constructed as a continuous wall that extends between the bottom surface of the bottom wall 52 of the inner basin 50 to the top surface 14 of the bottom wall 12 of the outer basin 10, more aptly shown in FIG. 5. This construction also prevents heavy loads in the cooler from compressing the cork insulation. The plurality of cork panels 40 includes a bottom wall cork panel 46 and a plurality of sidewall cork panels, 42 and 44, equal to the number of sidewalls on the outer basin 10. In the preferred embodiment, the outer basin includes four sidewalls and sidewall cork panels, 42 and 44. The cork panels 40 provide a natural insulator for maintaining ideal temperatures within the compartment 70. Cork 40 is also a "green" alternative to the hard open and closed cell insulation foam used in the prior art. The transparent inner basin 50 allows a cooler owner to inspect and detect leaks within the compartment 70 and in the basins, 10 and 50. Water, mold and other forms of contamination are thereby visibly apparent against the cork 40. As shown in FIG. 5, the inner basin sidewall 54 abuts the sidewall cork panel 42 against the outer basin sidewall 18. Additionally, the cork panels can be adorned with personalized indicia. Because the inner basin 50 is transparent, the cork panels 40 are viewable by the user when the lid assembly 80 is opened. Thus, it is contemplated that indicia maybe be printed on the cork panels 40 to provide a personalized cooler 1 for the user.

Figure 13:
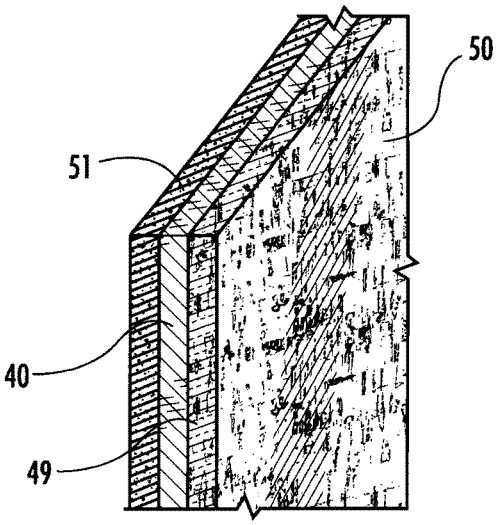
FIG. 13 is a cross-sectional view of an alternative embodiment of the cork panels of the present invention.

As shown in FIG. 13, it is also contemplated that the cork panels 40 have a secondary layer 48 attached thereto and adjacent to the inner basin 50, shown in FIG. 13. The secondary layer 48 can be a second layer of cork (which can include personalized indicia thereon) or a radiant barrier 49. The secondary layer 48 is positioned adjacent to the inner basin 40 and viewable through the transparent inner basin 40. Alternatively, the radiant barrier 49 can be positioned between the secondary layer and the cork panel to provide a radiant insulation that inhibits heat transfer by thermal radiation. The radiant barrier 49 may also be adorned with indicia thereon for customization purposes. The radiant barrier 49 can be constructed of metalized polyester, laminate polyester film, or the like. Alternatively, the cork panels could be secured to an insulation layer 51, such as expanded foam backing, adjacent to the outer basin, which gives the appearance that the entire cooler is formed from cork. This construction reduces the overall weight of the assembly. The insulation layer 51 of expanded foam backing provides better insulation in instances where the temperature of stored items is above 65 degrees C. Cork is an excellent thermal insulation material, and it is effective and resistant to compression; however, it provides its best performance in temperatures below 65 degrees C. The expanded foam backing ensures that the cooler assembly can be used in any temperature range without risk of losing insulation within the inner basin. The thickness of the cork panels, secondary layer, and insulation layer is limited by the spacing between the inner basin and outer basin. By way of example, the cooler could be lined with 1 inch of insulation layer, such as expanded foam, 1 inch of cork panel, and a thin secondary layer of either cork or radiant barrier.

Figure 4:
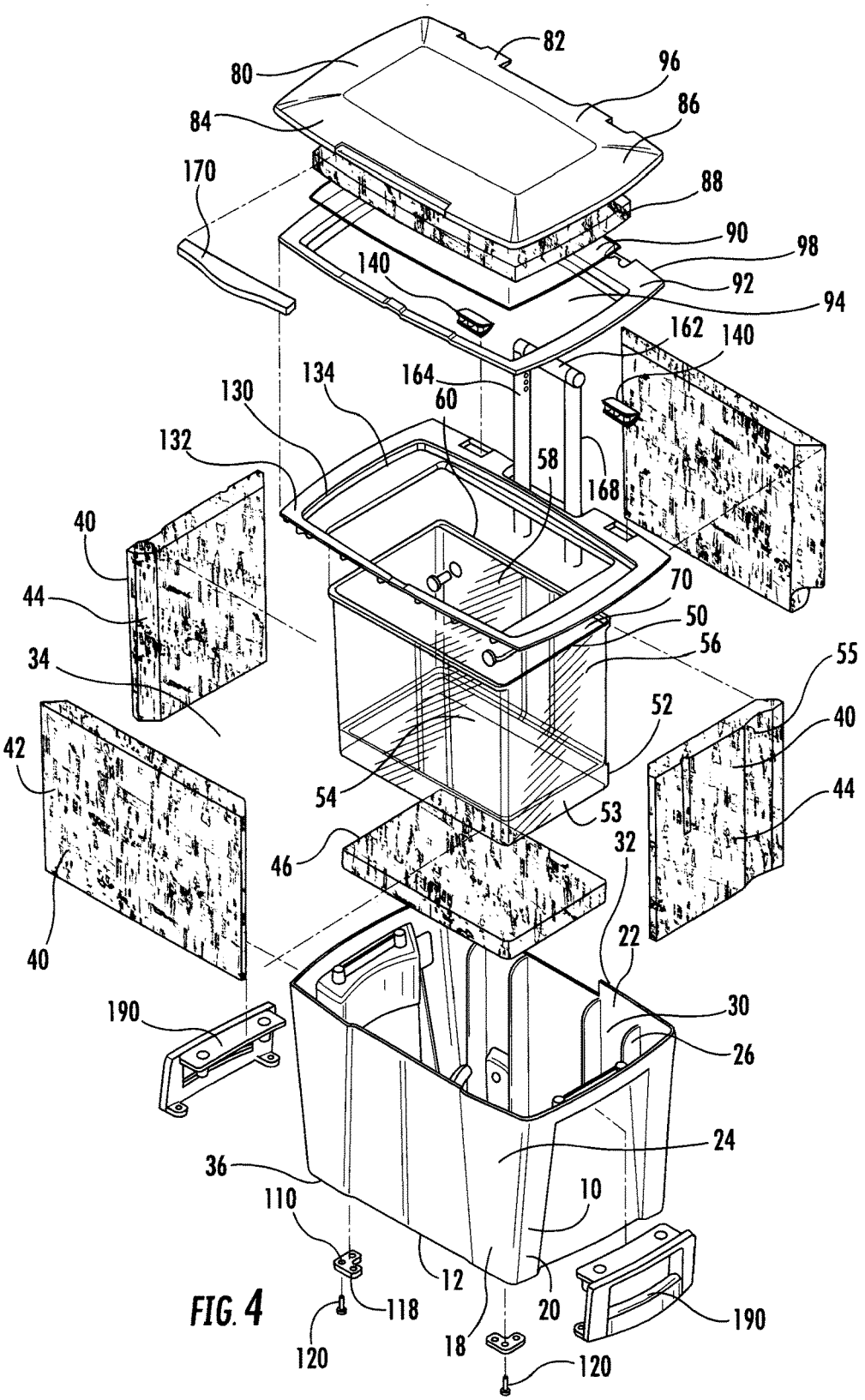
FIG. 4 is an exploded view of the alternative embodiment of the present invention.

Shown in FIG. 5, the inner basin bottom wall 52 abuts the bottom wall cork panel 46 against the outer basin bottom wall 12. As shown in FIG. 4, the outer basin sidewalls, 18 and 20, include an inner surface 22 and outer surface 24. The inner surface 22 of the sidewall may be provided with a plurality of vertically extending ribs 26 to provide structural integrity and strength to the cooler 1. Of note, cork's low thermal conductivity plus reasonable compressive strength make it an excellent material for thermal insulation where compression loads are present. The bottom cork panel 46 is under the most compressive load when the cooler is in use. Grooves 55 or the like may be conjugately formed into the outer surfaces of the cork insulation 40 to accept the ribs. Additionally, a removable inner basin divider 62 is contemplated to create compartments within the cooler 1, shown in FIG. 7. The inner basin 50 is lined with at least one pair of opposing channels 64 constructed and arranged to allow for the removable basin divider 62 to fit within the channels 64.

Figure 2:
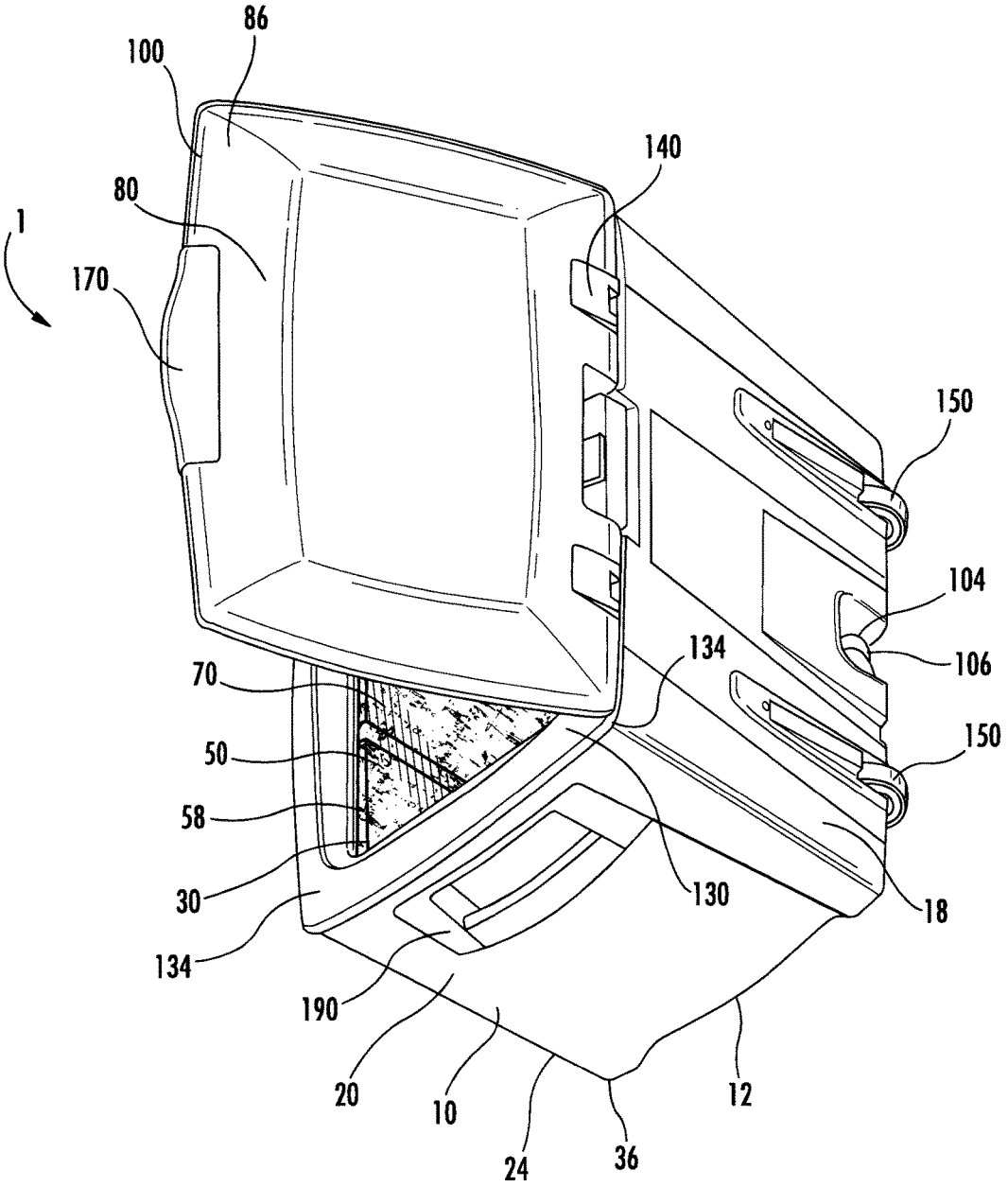
FIG. 2 is a perspective view of an alternative embodiment of the present invention.

As shown in FIGS. 1, 2, and 4, the lid assembly 80 is comprised of an outer lid 86, a top cork panel 88, a lid glass 90, and an inner lid 92. The inner lid 92 has a window framework 94 and is adapted to abut the clear lid glass 90. The lid assembly 80 is secured together, whereby the outer lid 86 provides the top surface 96 and the inner lid 92 provides a perimeter bottom surface 98, with the clear lid glass 90 making up the remainder of the inner lid. A basin top 130 is also provided. The basin top 130 has four elongated members 132 attached together to form a substantially rectangular frame 134 being adapted to abut a peripheral edge 32 on the open top 30 of the outer basin 10, and to abut a peripheral edge 60 on the open top 58 of the inner basin 50. The basin top 130 provides a smooth aesthetic appearance to the cooler and prevents liquids and moisture from infiltrating into the insulation. The basin top 130 and lid assembly 80 are hingedly connected together with at least one hinge 140 (FIG. 14) to allow the lid to pivot between an open position (FIG. 1) and a closed position (FIG. 3).

Figure 14:
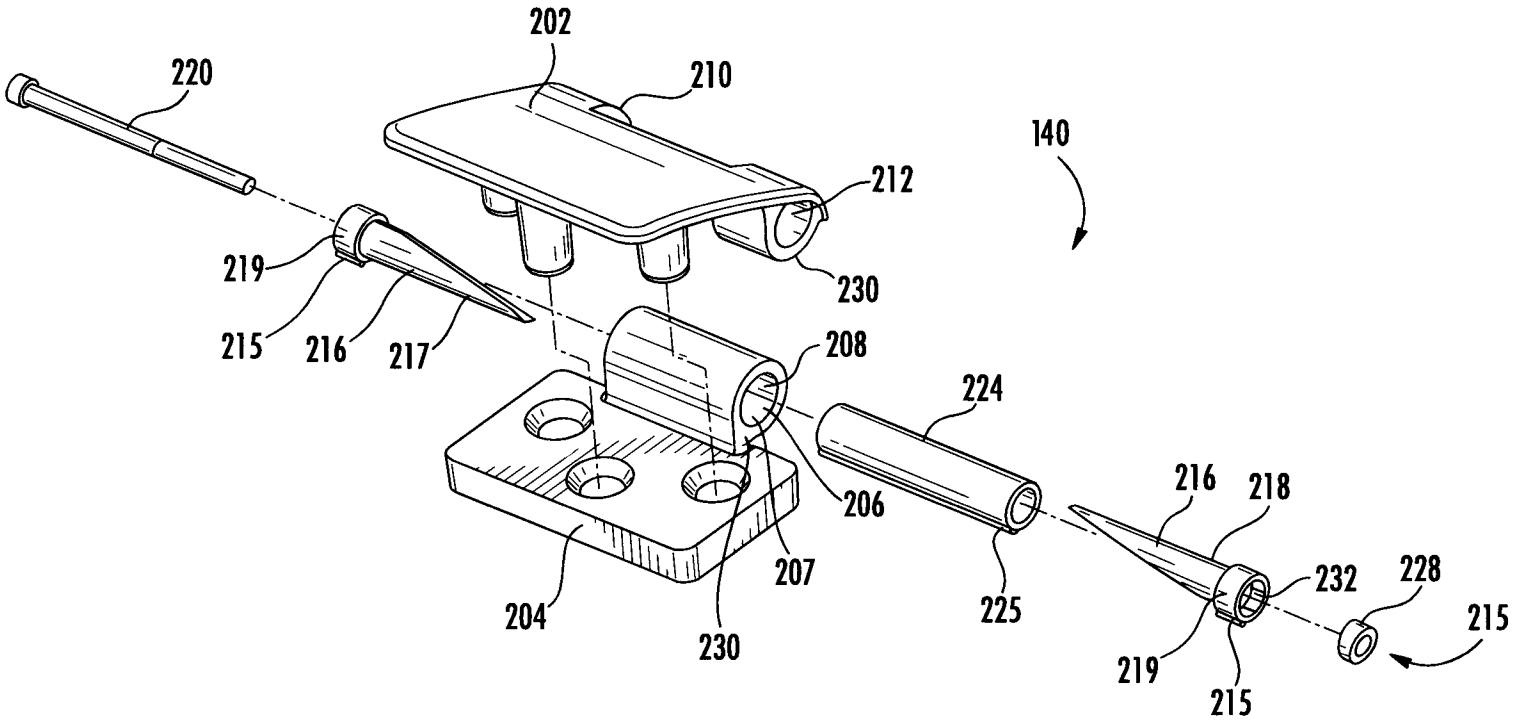
FIG. 14 is an exploded view of the constant torque friction hinge of the present invention.

Now referring to FIGS. 2-4 and 14, one embodiment of the constant friction hinge is illustrated. In general, the constant friction hinge 140 holds any position through the entire range of rotary motion of the lid assembly 80. The constant friction hinge 140 holds position by providing continuous resistance against motion through the entire range of rotary motion of the lid assembly 80 between the closed position and the open position. The constant friction hinges may be adjustable, allowing the resistance to be adjusted by the user. In this manner, a user of the device upon a ship in rough seas may set his hinges to provide increased resistance to movement. Whereas a cooler user on a picnic may want much less resistance to movement of the lid. As shown in FIG. 14, the constant friction hinge assembly 140 is comprised of an upper lid hinge 202 fastened to the lid assembly 80 and a lower lid hinge 204 fastened to the basin top 130 rotatably coupled together at a barrel 206. The barrel 206 includes a center barrel portion 208 on the lower lid hinge 204 and a first and second barrel portion, 210 and 212 on the upper lid hinge 202. The center barrel portion 208 is positioned between the first and second barrel portions, 210 and 212, to form the hinge barrel 206. The barrel portions, 208, 210, and 212, are aligned and coupled together by a friction bolt assembly 215. The friction bolt assembly 215 is comprised of a pair of wedge tubes 216, a barrel bolt 220, a tubular dowel 224, and a nut 228. The hinge barrel 206 is sized to accept the outer diameter of the tubular dowel 224 and each half of the wedge tubes 216 fit in an overlapping arrangement within the bore of the tubular dowel. The tubular dowel 224 includes a key 225 that is constructed and arranged to be inserted into a valley 230 along the interior surface 207 of the center barrel portion 208. The tubular dowel 224 has a length that is less than the total length of the hinge barrel 206. The barrel bolt 220 is generally a standard fastener having a headed end and a threaded end, the threads matching those of the nut member 228 for interlocking engagement between the two. The wedge tubes 216 are constructed so that they overlap each other within the tubular dowel 224 with the barrel bolt extending through an opening which extends through each wedge tube. Each wedge tube 216 is provided with an enlarged head portion 219 which include a hexagonal cavity 232 sized to cooperate with the nut member 228. The outer diameter of each enlarged head portion 219 includes a key member 215 that is sized to be inserted into the keyway 230 along the interior surface 207 of the first and second barrel portions, 210 and 212. The torque provided on the nut 228 and barrel bolt 220 draw the wedge tubes into engagement with each other to create friction within the tubular dowel which restricts movement between the center barrel portion 208 and the first and second barrel portions, 210 and 212, and thereby creates a friction hinge that holds any position through the entire range of motion of the lid assembly 80. It should also be noted that this construction allows the user to change the friction resistance of the hinge by tightening or loosening the barrel bolt 220.

Figure 8:
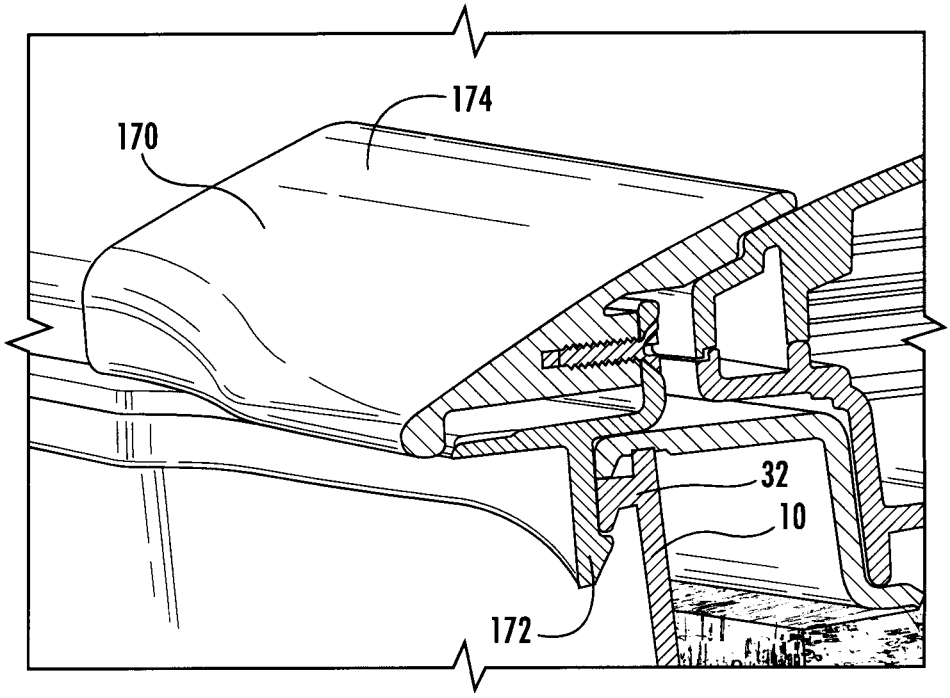
FIG. 8 is a cross-sectional view of the latch assembly of the present invention.
Figure 9:
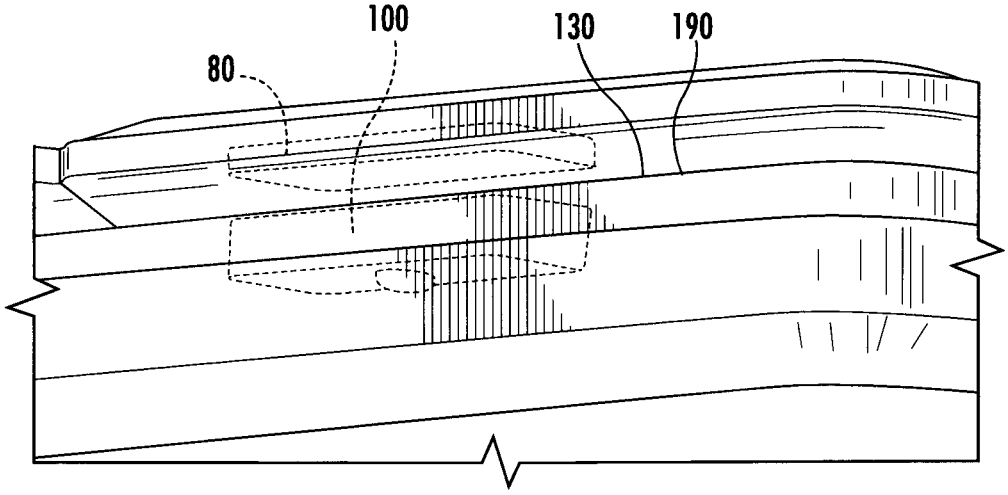
FIG. 9 is a bottom perspective view of the lid assembly of the present invention.

A latch assembly 170 is provided to keep the lid assembly 80 in a closed position 102. The latch assembly 170 is preferably positioned on the front end of the lid; however, any position around the perimeter of the lid suitable for holding the lid closed may be utilized without departing from the scope of the invention. In one embodiment, the latch assembly 170 is constructed of aluminum; however, other materials are contemplated. As shown in FIGS. 8 and 9, the latch assembly 170 includes an integrated latch 172 that catches on the rim of the basin top 130 to close the lid assembly 80. When a user pushes up on the lid handle 174, the latch 172 releases from the peripheral edge 32 of the outer basin 10 and allows the lid assembly 80 to open. In another embodiment, the lid assembly 80 includes at least one, and more preferably a plurality of concealed lid retention magnets 100 disposed on the bottom surface of the basin top 130, shown in FIG. 9. The concealed magnets 100 are magnetically attracted to the metal framework of the inner lid panel 92. It is contemplated that the inner lid 92 is constructed of steel or other suitable magnetically attracted materials.

Figure 3:
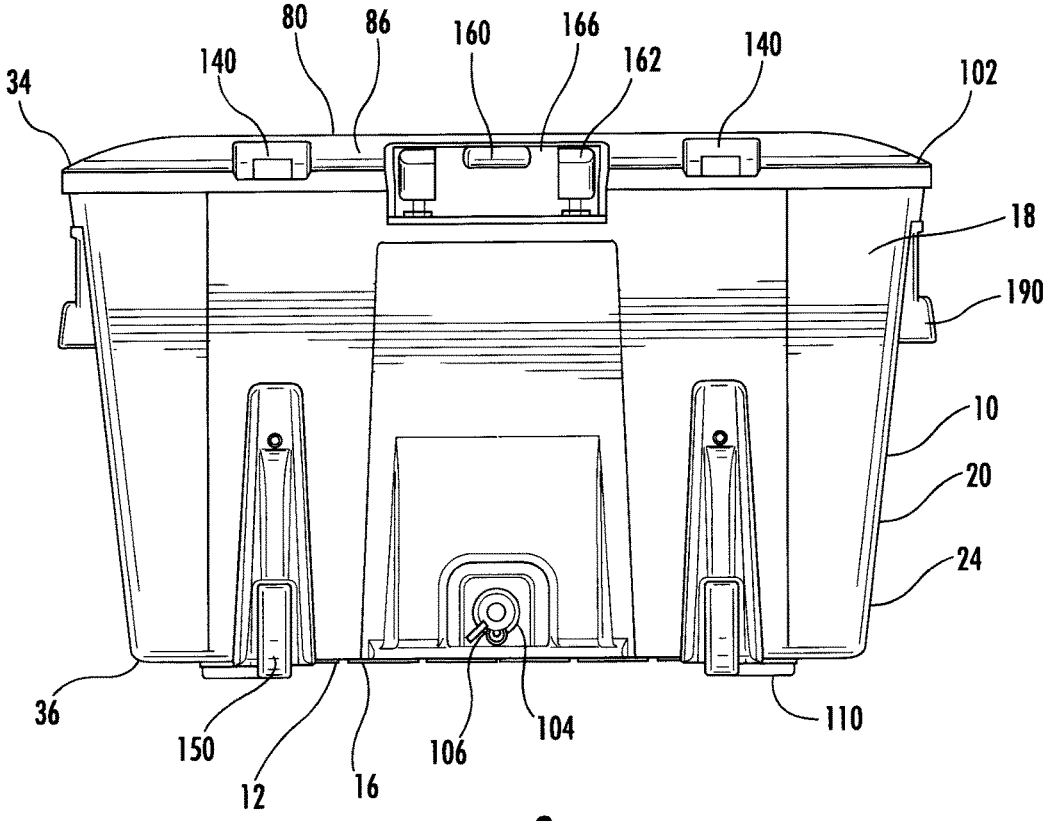
FIG. 3 is a back view of the alternative embodiment of the present invention.
Figure 10:
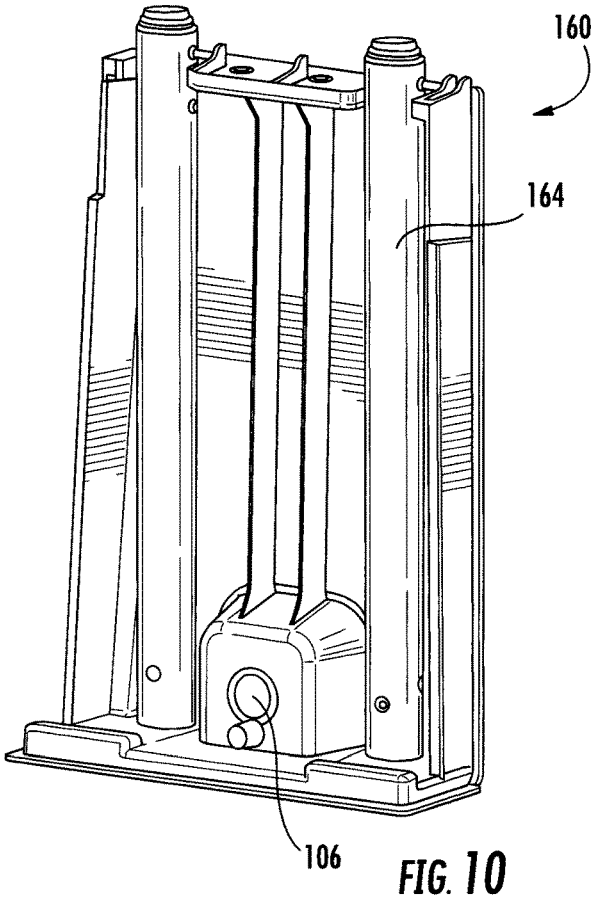
FIG. 10 is a perspective view of the handle assembly of the present invention.
Figure 11:
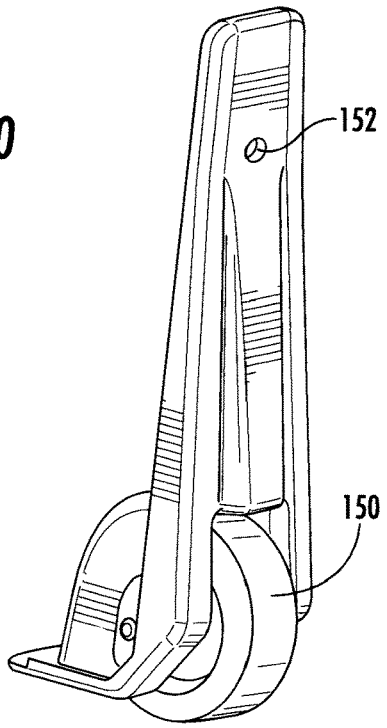
FIG. 11 is a perspective view of the wheel assembly of the present invention.

In an alternative embodiment, the cooler 1 is further provided with wheels 150 and a retractable handle 160 as shown in FIGS. 3 and 4. Along one sidewall 18 on the outer basin 10 at the bottom end 36 is positioned a pair of wheels 150; and between the pair of wheels 150 along the top end 34 on the same sidewall 18 on the outer basin 10 is positioned a retractable handle 160. The retractable handle 160 is movable between a retracted position 166, which is flush with the lid assembly 80 and an open position 168 (FIG. 4). In the open position, the handle extends a predetermined length vertically with respect to the lid assembly 80. The retractable handle 160 includes a handle 162 and a telescoping track 164. The track 164 is disposed between the outer and inner basin, 10 and 50, for slidable engagement of the handle 162. As shown in FIGS. 10 and 11, it is contemplated that the retractable handle 160 and the caster wheels 150 are removably fastened along one of the longer sidewalls 18 on the outer basin 10. It is contemplated that the caster wheel assembly 150 and retractable handle assembly 160 are fastened to the outer basin 10 using snap fasteners, rivets, snap-lock, or the like. By fastening the retractable handle assembly 160 and wheel assembly 150 to the outer basin 10, and not through the cork panels 40 or inner basin 50, the interior compartment 70 of the cooler 1 remains free from the outside elements. The caster wheel assembly 150 includes a snap fit fastener 152 attachable to the outer basin 10, and the retractable handle assembly 160 similarly includes a snap fit fastener 161 (FIG. 3) attached to the outer basin 10.

Figure 12:
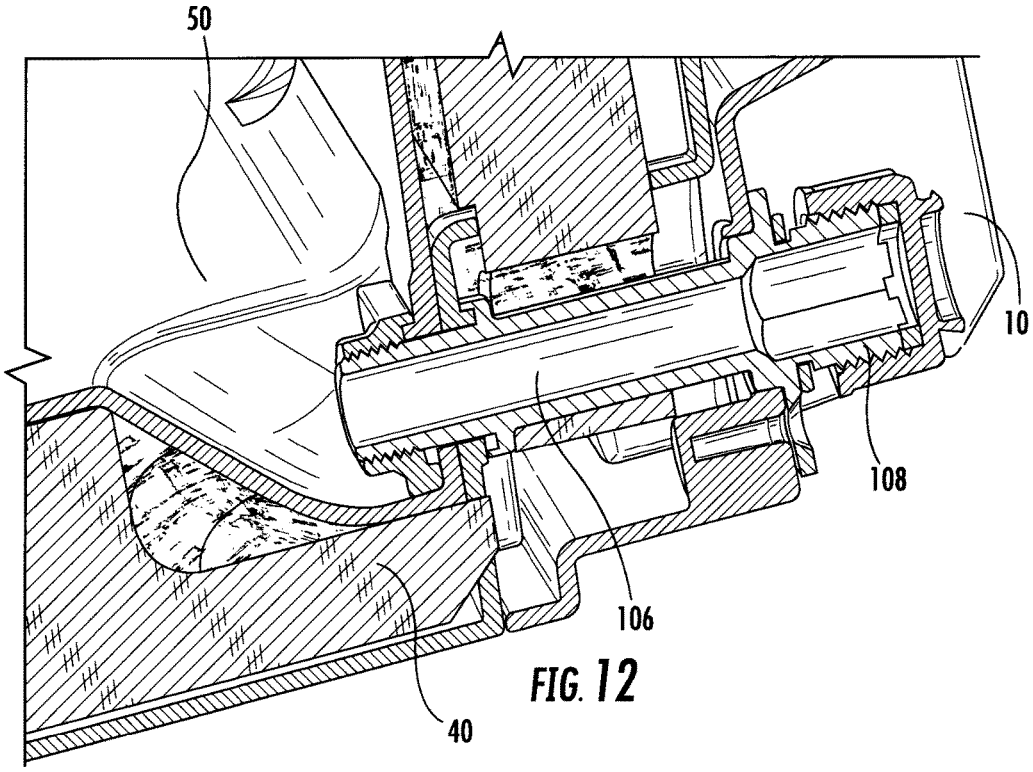
FIG. 12 is a cross-sectional view of the drain hole of the present invention.

Furthermore, between the caster wheels 150 and along the bottom end 36 of the outer basin sidewall 18 is a drain hole 106 with an attachably removable drain plug 104; see FIGS. 3, 10 and 12. The drain hole 106 is in fluid communication with the compartment 70. The drain hole 106 extends from the outer basin 10 to the compartment 70. The drain plug 104 is positioned on the same sidewall 18 as the caster wheels 150 and retractable handle 160 so that, when the handle 162 is retracted and tilted, the drain plug 104 can be removed to allow for all the water within the compartment 70 of the cooler 1 to be drained. Additionally, the drain hole 106 further includes a threading 108 constructed and arranged to accept a garden hose fitting, shown in FIG. 12. The garden hose thread 108 allows a user to either drain water from the cooler 1 through a garden hose to another location or pump fluid into the cooler 1. For instance, the garden hose thread 108 allows a user to connect a garden hose thereto and divert drainage water away from the cooler 1 to an area more sanitary or suitable. On each of the opposite shorter sidewalls 20 on the outer basin 10 along the top end 34 is a side handle 190, shown in FIGS. 2, 3 and 4. Each handle 190 is fixed in position, but it is contemplated that each handle 190 can pivot about its ends, not shown.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention, and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. A constant friction hinge assembly comprising:

a basin assembly having four side panels, a base panel and an open top;

a lid, said lid including an outer panel said lid hingedly connected to said basin for movement between an open position and a closed position;

a constant friction hinge assembly connecting said basin assembly and said lid, said constant friction hinge assembly being rotatably coupled together at a hinge barrel including a center barrel portion positioned between a first barrel portion and a second barrel portion, to form said hinge barrel, said center barrel portion, said first barrel portion and said second barrel portion aligned and coupled together by a friction bolt assembly, said friction bolt assembly includes a pair of opposing wedge tubes positioned in an overlapping manner with respect to each other within said hinge barrel, a friction bolt extending through a central portion of each said wedge tube, whereby said friction bolt is constructed and arranged to control the amount of overlap of said wedge tubes to increase or decrease friction provided by said constant friction hinge assembly, said constant friction hinge assembly being constructed and arranged to allow said lid to be rotated to any desired position between said open position and said closed position, whereby said hinge will maintain said positioning without application of an externally applied force.

2. The constant friction hinge assembly of claim 1 wherein said constant friction hinge assembly provides a substantially constant resistance to rotation of said lid throughout its entire range of rotation.

3. The constant friction hinge assembly of claim 2 wherein said resistance to rotation is adjustable.

4. The constant friction hinge assembly of claim 1 wherein said constant friction hinge assembly includes a tubular dowel member extending through said center barrel portion and said first and said second barrel portions, an outer diameter of said tubular dowel cooperating with an inner diameter of said center barrel portion and said first and said second barrel portions, said pair of opposing wedge tubes positioned in an inner bore of said tubular dowel member.

5. The constant friction hinge assembly of claim 4 wherein said tubular dowel includes a key extending at least partially along the length thereof, said center barrel portion including a keyway sized to cooperate with said key on said tubular dowel member to prevent rotation of said dowel within said center barrel portion.

6. The constant friction hinge assembly of claim 4 wherein said tubular dowel includes a key extending at least partially along the length thereof, said first barrel portion and said second barrel portion including a keyway sized to cooperate with said key on said tubular dowel member to prevent rotation of said dowel within said first barrel portion and said second barrel portion.

7. The constant friction hinge assembly of claim 1 wherein said friction bolt assembly includes a standard fastener having a headed end and a threaded end, the threads matching those of a nut member for interlocking engagement between the two.

8. The constant friction hinge assembly of claim 7 wherein each said wedge tube is provided with an enlarged head portion which includes a hexagonal cavity sized to cooperate with said nut member.

9. The constant friction hinge assembly of claim 8 wherein an outer diameter of each said enlarged head portion includes a key member that is sized to be inserted into a keyway along an interior surface of said first barrel portion and said second barrel portion, and whereby torque provided on said nut member and said friction bolt draw said wedge tubes into engagement with each other to create friction within said tubular dowel which restricts movement between the center barrel portion and said first and said second barrel portions.

10. The constant friction hinge assembly of claim 9 wherein said tubular dowel is expandable upon application of a radial force from within said bore of said tubular dowel.

11. The constant friction hinge assembly of claim 9 wherein said tubular dowel is deformable upon application of a radial force from within said bore of said tubular dowel.

* * * * *